US005689967A

United States Patent [19]

Fløysvik

[11] Patent Number: 5,689,967

[45] Date of Patent: Nov. 25, 1997

[54] BOTTLE COOLER

[75] Inventor: Jan Egil Fløysvik, Sandnes, Norway

[73] Assignee: Aktiebolaget Electrolux, Stockholm, Sweden

[21] Appl. No.: 693,317

[22] PCT Filed: Feb. 13, 1995

[86] PCT No.: PCT/NO95/00031

§ 371 Date: Oct. 18, 1996

§ 102(e) Date: Oct. 18, 1996

[87] PCT Pub. No.: WO95/21560

PCT Pub. Date: Aug. 17, 1995

[30] Foreign Application Priority Data

Feb. 14, 1994 [NO] Norway ..... 940486

[51] Int. Cl.[6] ..... A47F 3/04

[52] U.S. Cl. ..... 62/255; 62/275

[58] Field of Search ..... 62/255, 256, 275

[56] References Cited

U.S. PATENT DOCUMENTS

| | | | |
|---|---|---|---|
| 3,261,173 | 7/1966 | Gould | 62/275 |
| 3,306,068 | 2/1967 | Allgeyer et al. | 62/256 |
| 3,769,805 | 11/1973 | Corini | 62/255 |
| 4,267,706 | 5/1981 | Abrahm | 62/256 |
| 4,314,458 | 2/1982 | Hade et al. | 62/256 |
| 4,373,355 | 2/1983 | Monroe | 62/256 |
| 4,777,806 | 10/1988 | Perez | 62/256 |
| 5,058,393 | 10/1991 | Callon et al. | 62/255 |

FOREIGN PATENT DOCUMENTS 1295475 12/1962 France .

*Primary Examiner*—William E. Tapolcai

*Attorney, Agent, or Firm*—Andrus, Sceales, Starke & Sawall

[57] ABSTRACT

The invention relates to a bottle cooler where bottles, cans and similar containers, preferably containing beverages, are offered for sale in cooled condition comprising a cooling machine (3, 5, 7) for cooling air which is supplied to the bottles (14), etc. The bottle cooler is built up on a standing pipe (1), which below is assigned a blower/fan means (2) in order to drive cooled air up through the pipe (1), which above is provided with at least one opening (1"), through which the cooled air flows out from the pipe (1) which, in the upper portion thereof, is surrounded by an air flowing-down and bottle accommodating chamber, and, at a certain distance below the lower edge of the hood (17), a bottle supporting shelf (13) is disposed, from where the bottles (14) are available for the purchasing public, and which is surrounded by a lateral supporting wall or the like (15) for the bottles, said wall (15) being formed with holes. (16) intended to allow return flow of the cooled air supplied to the bottles (14), back to the cooling machine (3, 5, 7).

7 Claims, 2 Drawing Sheets

BOTTLE COOLER

BACKGROUND OF THE INVENTION

This invention relates to a bottle cooler wherein bottles, cans and similar containers, preferably containing beverages, are offered for sale in cooled condition.

Prior art includes cabinet-shaped refrigerating counters wherein the bottles, of which the liquid content is to be cooled, are placed on shelves. In such a refrigerator, it is not easy to get oneself a view of what kind of drinks are contained in the cabinet on the various shelves. Cabinet-shaped refrigerating counters have a swingable door at one of the four sides. Thus, such a refrigerating counter is poorly suited to be placed in the middle of the business premises in order to attract maximum attention for sale-promoting purposes. A negative feature in this respect is that the bottles in fact are kept concealed within the cabinet and can only be seen when they are located close to the glass door, preferably when the latter is swung open.

SUMMARY OF THE INVENTION

In accordance with the present invention, one has aimed at eliminating deficiencies, disadvantages and limitations of use relating to prior art technique and, thus, providing a refrigerating counter of the kind defined introductorily, exhibiting a sale-promoting construction wherein bottles and/or similar containers for beverages become easily visible, and including a suitable storage which may be filled with bottles which, thereafter, as bottles are removed from the display shelf of the bottle cooler, automatically refills said display shelf, and wherein provision has been made for an adequate cooling system comprising recovery of cooled air, possibility of evaporating formed condensate, etc.

According to the invention, said objects are realized through designing a bottle cooler of the kind concerned, in accordance with the features appearing from the following claims.

A bottle cooler according to the invention comprises an in per se known cooling machine which is positioned in the lower portion of the bottle cooler.

Above the cooling machine, the bottle cooler has been built up on a standing pipe having at least one through-going opening at the upper portion thereof: which is surrounded by a downwardly open hood. A distance beneath the lower edge of the hood, a support shelf for bottles, cans and/or other containers for beverages is disposed. In the area of this shelf, in the adjacent wall surrounding the standing pipe, perforations are formed.

When the cooling machine produces cooled air, this air will be brought to flow upwardly (against its natural flow direction) by means of a fan, from the lower end of the standing pipe to the upper portion of the standing pipe and out through said opening(s) and into the room surrounded by the hood. Here, the larger weight of the cooled air can be utilized to let it "fall" down onto the bottles which are stacked upon the support shelf which, in the circumferential direction, may extend wholly or in part around the standing pipe. During the air's downward flowing, the cooled air cools the bottles and, thus, the content thereof, such that condensate is formed. This condensate becomes drained off as it is formed through the perforations in said wall portion surrounding the standing pipe.

Thus, said condensate is drained off together with cooling air which has accommodated some heat from the bottles, through said perforations, and lands ultimately on a heating plate adapted to evaporate the condensate and which may be based on the use of heat gas pipes.

The evaporator of the cooling machine will be placed within a widened lower portion of the standing pipe, beneath the fan for the cold air's transport upwardly within the standing pipe. Below a horizontal wall having a vertical, central pipe for conveying condensate to said heating plate, a compressor and an air-cooled condenser have been disposed, opposite said heating plate.

The necessary amount of air for the condenser is taken in through the perforations in the bottom portion of the bottle cooler's double-walled casing. This air is then about 10° C. higher and somewhat more moist than the cooled air. A built-in thermostat, set on e.g. 7° C., provides the temperature control.

A particular advantage of a bottle cooler built up in accordance with the present invention is that it, using insignificant constructive modifications, can be shaped as a big bottle, the hood surrounding the uppermost portion of the standing pipe easily being formed as the upper part of a bottle, including bottle capsule and neck, e.g. adapted to the special bottles for the beverage offered for sale in cooled condition, the double-walled casing of the bottle cooler easily being shaped to conform to the bottom portion of the gigantic bottle concerned. With such a design, the top and bottom portions of the gigantic bottle/bottle cooler will be broken by the bottles resting on the support shelf, entirely according to the purpose.

BRIEF DESCRIPTION OF THE DRAWING

An example of a preferred embodiment of a bottle cooler according to the invention is further explained in the following, reference being made to the accompanying drawings, wherein.

DETAILED DESCRIPTION OF THE PREFERRED EMBODIMENTS

Figure 1:
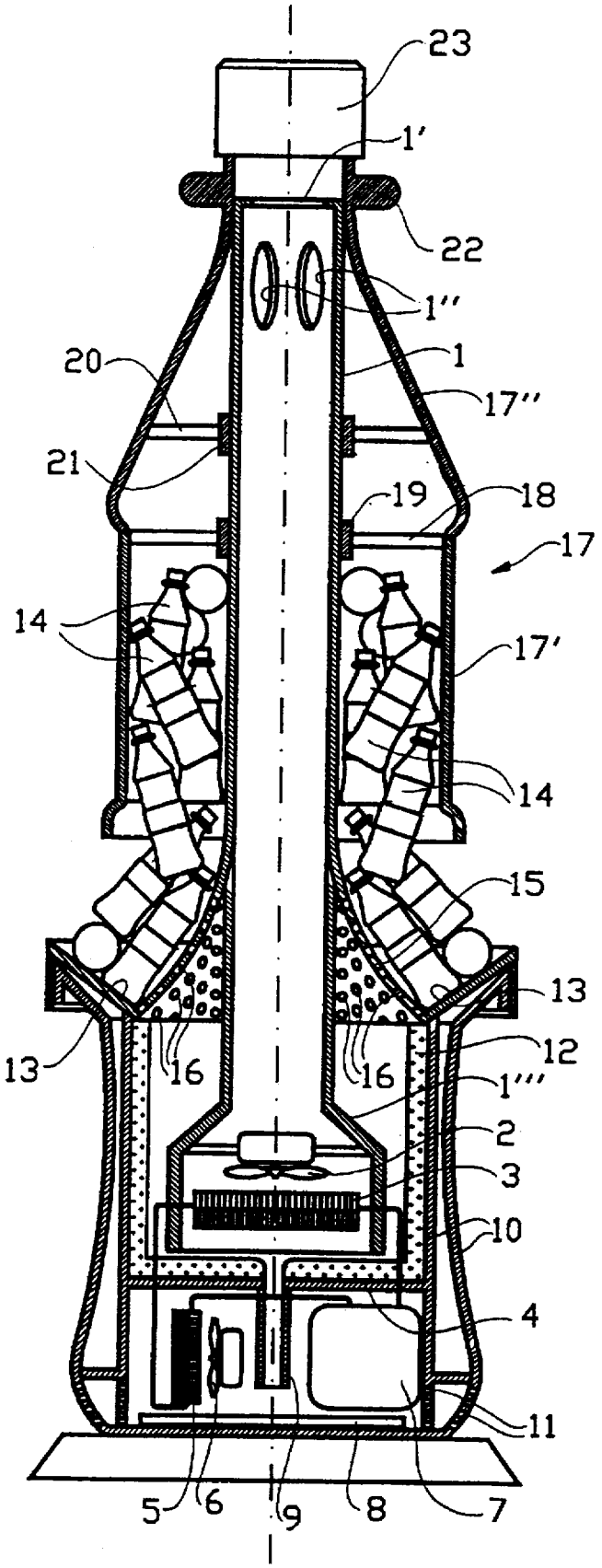
FIG. 1 shows a vertical axial section through a bottle-shaped bottle cooler having an upper displaceable part of a hood in a bottom, operative position.

According to the embodiment, a refrigerating counter in accordance with the present invention is built up on a central, standing pipe 1 having an upper, axially directed end opening 1' and one or more through-going radial openings 1". The central standing pipe 1 has a lower, widened portion 1'", in which is placed a fan 2 for forced cold air flow up through the pipe 1 to the radial openings 1", and an evaporator 3 which is included in a known cooling machine which, moreover, below a horizontal plate 4, comprises an air-cooled condenser 5 having an assigned fan 6 and a compressor 7. Just below the condenser 5, the air fan 6 and the compressor 7, a horizontal heating plate 8 is mounted for evaporating condensate which, possibly, is supplied through a central, vertical pipe 9 through the horizontal plate 4.

The cooling machine 3,5,7 and the lower portion of the standing pipe 1 are surrounded by a double-walled casing 10 having air supply perforations 11 in the bottom portion thereof, 12 denoting an insulation.

At the upper end of the double-walled casing 10, is disposed an inclined supporting plane 13 for bottles 14, said supporting plane 13, at the radially inner edge thereof, joins an inclined lateral supporting plane 15.

The lateral supporting plane 15 for the bottles 14 is formed by an outwardly concave, upwardly tapering, conical sleeve surrounding a portion of the standing pipe 1, and has through-going perforations 16, in order to attend to that cold air which has been supplied through the fan 2 and have fallen down over the bottles and accommodated some heat from these, again has the opportunity of flowing into the cooling machine.

In order to conduct cold air from the pipe's 1 upper openings 1" downwards to the underlying bottles 14, the pipe 1 is surrounded by a divided hood generally denoted by the 'reference numeral 17, consisting of a lower, stationary, sleeve-shaped part 17' which is positioned and anchored in relation to the pipe 1 by means of radial arms 18 having anchoring means 19 or in another suitable way. The upper, conically upwardly tapering hood part 17" is axially displaceably disposed on the pipe 1, by means of radial arms 20 having guide means 21 or in another suitable way.

Uppermost, the upper, axially displaceable hood part 17" has a non-functional bead 22 and thereabove a capsule 23. Both these parts are intended to contribute to give the bottle cooler the look of a bottle, particularly a bottle of the kind offered for sale. The shape of the hood parts 17', 17" are also intended to obtain similarity of the bottle shape 14.

Besides, the upper hood part 17" serves to define a room above the bottles 14 in which cooled air from the upper radial openings 1" of the pipe is to fall undisturbed down on the bottles 14.

Figure 2:
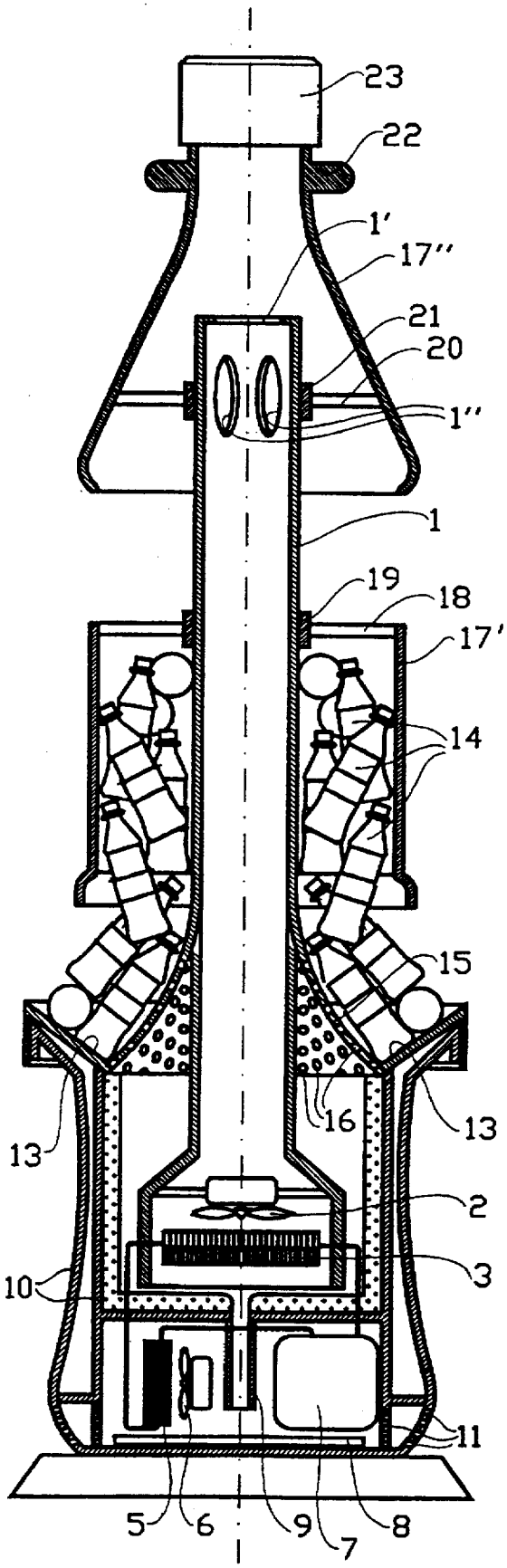
FIG. 2 corresponds to FIG. 1, but shows said upper displaceable hood part in a top, inoperative position, in order to enable filling of the hood's lower non-displaceable part constituting bottle storage.

The lower hood part 17' serves as a refilling chamber and storage for bottles 14. In FIG. 2, the upper hood part has been pulled up in order to enable filling of the bottle cooler with further bottles 14, not only in the area immediately above the supporting plane 13 and the inclined lateral supporting plane 15, but also within the "storage" 17'. As bottles 14 are removed from the visible stack of bottles, defined between the supporting plane 13 and the inclined lateral supporting plane 15, new bottles slide down from the fixed hood part/storage 17'.

The cold air falling down over the bottles 14 within the "open" part (as opposed to the storage 17') of the bottle cooler cools these available bottles 14 so that condensate is formed, this exposing the cooling effect. This condensate is drained off through the perforations 16 in the lateral supporting cone 15 and lands, possibly together with other condensate, in the central, vertical pipe 9 extending through the horizontal plate 4, and drips therefrom down on the heating plate 8, which evaporates condensate supplied thereto.

I claim:

1. A bottle cooler wherein bottles, cans and similar containers, are offered for sale in cooled condition, comprising a cooling machine (3, 5, 7) for cooling air which is supplied to the bottles (14), characterized in that the bottle cooler is built up on a standing pipe (1) which, below, is assigned a blowing/fan means (2) in order to drive cooled air up through the pipe (1) which, above, is provided with at least one opening (1") through which the cooled air flows out from the pipe (1) which in the upper portion thereof, is surrounded by a downwardly open hood (17), said hood being comprised of two relatively axially displaceable parts, an upper displaceable hood part (17") and a lower fixed hood part (17'), said hood parts cooperating to conduct cooled air downwardly towards the bottles (14), with said lower fixed hood part (17') having an open lower end and defining a refillable storage chamber for the bottles (14) and a bottle supporting shelf (13) disposed below the open end of said lower hood part (17') to define a bottle display area between said lower hood part (17') and said shelf (13), said display area including a perforated supporting wall (15) to allow the cooled air supplied to the bottles (14) to flow back to the cooling machine (3, 5, 7).

2. A bottle cooler as set forth in claim 1, characterized in that said blowing/fan means (2) is disposed above the cooling machine (3,5,7) within a lower, widened portion of the standing pipe (1).

3. A bottle cooler as set forth in claim 1, characterized in that, below the cooling machine (3,5,7), a heating plate (8) is disposed, in order to evaporate possible condensate brought along with the return air into the interior of the bottle cooler.

4. A bottle cooler as set forth in claim 1, characterized in that the perforated supporting wall (15), which is formed with through-going holes (16) for return air into the interior of the bottle cooler, has a radially outwardly concave course, tapering approximately conically in an upward direction.

5. A bottle cooler as set forth in claim 1, characterized in that the bottle supporting shelf (13) slopes upwardly in a radial outward direction.

6. A bottle cooler as set forth in claim 1, characterized in that said standing pipe (1) is placed centrally within the bottle cooler.

7. A bottle cooler as set forth in claim 6, characterized in that the bottle cooler is shaped as a giant bottle, of which the hood (17) forms the upper part, the lower part being formed by a double-walled casing (10), an intermediate area serving to offer the bottles (14) for sale in cooled condition.

* * * * *